United States Patent [19]

McCoig

[11] Patent Number: 4,925,056

[45] Date of Patent: May 15, 1990

[54] APPARATUS FACILITATING THE USE OF A PLASTIC GROCERY BAG AS A TRASH CONTAINER

[76] Inventor: James E. McCoig, Rte. #1, Box 270A, White Pine, Tenn. 37890

[21] Appl. No.: 253,569

[22] Filed: Oct. 4, 1988

[51] Int. Cl.[5] ..... B65D 90/04

[52] U.S. Cl. ..... 220/404; 220/1 T; 248/95

[58] Field of Search ..... 220/1 T, 404, 403; 248/95, 100, 99, 101

[56] References Cited

U.S. PATENT DOCUMENTS

| | | | |
|---|---|---|---|
| 3,977,450 | 5/1976 | Schampie | 248/95 |
| 4,558,800 | 12/1985 | Isgar | 220/403 |
| 4,723,740 | 2/1988 | Courtemanche | 248/95 |
| 4,735,340 | 4/1988 | Preston | 220/404 |

*Primary Examiner*—Steven M. Pollard

*Attorney, Agent, or Firm*—Luedeka, Hodes & Neely

[57] ABSTRACT

Apparatus facilitating the use of a plastic grocery bag as a trash container may take the form of an adapter for supporting the plastic grocery gag in a condition for receiving trash, a trash can for supporting the plastic bag as a liner therein or a clip for securing the plastic bag within a trash can. The adapter form of the apparatus includes a ring adapted to be snugly received by the opening of the plastic bag and a plurality of spike-like formations for puncturing the walls of the plastic bag and for thereby suspending the plastic bag from the adapter. Furthermore and inasmuch as each plastic grocery bag commonly includes a pair of handle-providing apertures adjacent the opening of the bag, the adapter includes a pair of hook-like projections intregally connected to the ring for projecting through the handle-providing apertures of the bag permitting the bag and ring to be suspended across the mouth of a trash can. The trash can form of the apparatus includes a plurality of spike-like formations positioned adjacent the mouth of the trash can and arranged so as to project generally inwardly of the can. When a plastic bag is operatively positioned within the trash can so that its edge portions are hooked about the spike-like formations, the plastic bag is suspended within the trash can so as to provide a liner therefor. The clip form of the apparatus includes a pair of arm portions adapted to be positioned about an edge of the mouth of a trash can and an edge portion of the bag draped across the mouth edge for clipping the bag to the trash can.

1 Claim, 3 Drawing Sheets

APPARATUS FACILITATING THE USE OF A PLASTIC GROCERY BAG AS A TRASH CONTAINER

BACKGROUND OF THE INVENTION

This invention relates generally to plastic bags of the type commonly supplied by grocery stores for enabling a customer to carry groceries from the store and relates more particularly to the utilization of such plastic grocery bags as trash containers.

Plastic bags of the type commonly used for carrying groceries from a grocery store each include flexible walls defining the interior of the bag and an opening providing ingress into and egress from the bag interior. It is desirable to provide means by which such a plastic grocery bag can be effectively utilized as a container for holding trash, once the grocery-carrying purpose of the bag has been fulfilled. It is also desirable to provide means for adapting the bag as a liner for a trash can.

Accordingly, it is an object of the present invention to provide an adapter for a plastic grocery bag of the aforedescribed type which facilitates the use of the plastic bag as a trash container.

Another object of the present invention is to provide such an adapter which readily adapts the plastic bag as a liner for a trash can.

Another object of the present invention is to provide such an adapter which can be used with a trash can having a mouth possessing any of a number of shapes.

Yet another object of the present invention is to provide means for supporting a bag in an open-end-up condition from a horizontal edge provided, for example, by the upper edge of the kitchen cabinet door.

A further object of the present invention is to provide a new and improved trash can including means for supportedly holding a plastic grocery bag of the aforedescribed type within the mouth of the trash can.

A still further object of the present invention is to provide a new and improved clip for holding a plastic bag of the aforedescribed type within the mouth of a trash can.

SUMMARY OF THE INVENTION

This invention resides in apparatus facilitating the use of a plastic grocery bag as a trash container wherein the grocery bag is of a type having flexible walls defining the bag interior, an opening providing ingress into and egress from the bag interior, an edge portion encircling the bag opening and a pair of handle-providing apertures defined in the bag edge portion.

In one aspect of the present invention, the apparatus is in the form of an adapter including a ring adapted to be snugly accepted by the opening of the bag for maintaining the bag opening in an opened condition and first means associated with the ring for releasably securing the edge portion of the bag about the ring. The adapter further includes second means associated with the ring including at least one portion projecting generally radially outwardly of the ring for projecting through one of the handle-providing apertures of the bag when the ring is operatively accepted by the bag opening for supporting the bag from a support structure with the bag opening maintained in an opened condition for accepting trash placed therein.

In another aspect of the present invention, the apparatus is in the form of a trash can including means defining a receptacle for trash wherein the receptacle defines an interior cavity and a mouth providing ingress into and egress from the interior cavity of the can. The trash can further includes means associated with the receptacle and located adjacent the mouth thereof for cooperating with the edge portion of the plastic bag so that when the bag is operatively positioned within the interior cavity of the can, the edge portion of the bag is releasably secured within the mouth of the receptacle.

In a further aspect of the present invention, the apparatus is in the form of a clip for securing a plastic bag within the mouth of a trash can. The clip includes means defining two arms joined together so as to provide two free end arm portions extending generally alongside one another and adapted to be snugly secured about the border section of the trash can mouth so that when the plastic bag is operatively positioned within the interior cavity of the trash can and its edge portion is draped across the edge of the trash can mouth, the clip can be positioned about the edge of the trash can mouth and the bag edge portion draped thereacross so that the bag edge portion is tightly held about the edge of the trash can mouth between the two arms of the clip.

BRIEF DESCRIPTION OF THE DRAWING FIGURES

DETAILED DESCRIPTION OF THE ILLUSTRATED EMBODIMENTS

Figure 1:
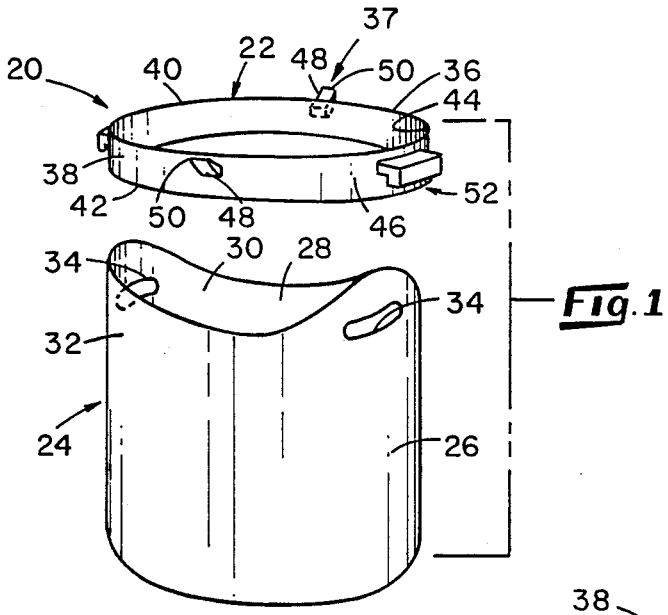
FIG. 1 is a perspective view of an adapter in accordance with one aspect of the present invention and a plastic bag with which the adapter is utilized.

Turning now to the drawings in greater detail and considering first FIG. 1, there is illustrated a trash container assembly, generally indicated 20, comprised of an adapter 22 in accordance with one aspect of the present invention and a plastic grocery bag 24 of the type with which the adapter 22 is used. The plastic bag 24 includes walls 26 defining an interior 28 and an opening 30 providing ingress into and egress from the bag interior 28. As is apparent herein, the adapter 20 is adapted to be operatively positioned within the bag opening 30 for maintaining the opening 30 in an opened condition for accepting trash placed therein.

With reference still to FIG. 1, the walls 26 of the plastic bag 24 are relatively thin and flexible. Further, there is defined by the bag walls 26 an edge portion 32 generally encircling so as to border the opening 30. The edge portion 32 defines two slot-like apertures 34 positioned on diametrically-opposed sides of the bag 24 for providing handles with which the bag 24 can be carried.

Figure 2:
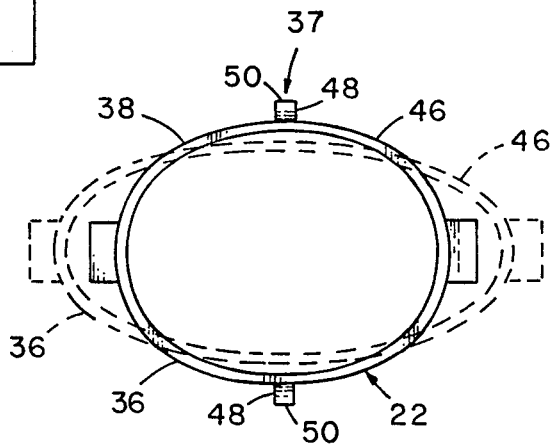
FIG. 2 is a plan view of the FIG. 1 adapter as seen generally from above in FIG. 1.
Figure 3:
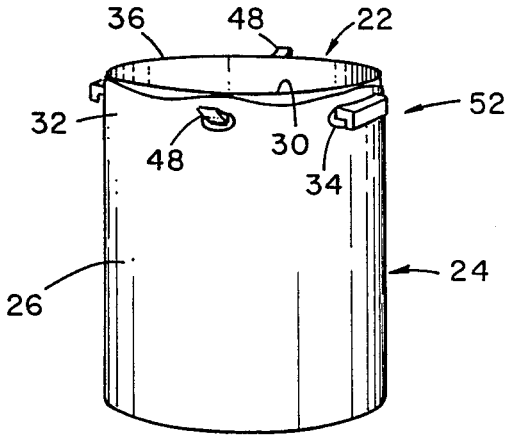
FIG. 3 is a perspective view the FIG. 1 adapter and bag in an assembled condition.

With reference to FIGS. 1–3, the adapter 22 includes means defining a ring 36 and means, generally indicated 37, associated with the ring 36 for securing the opening 30 of the bag 24 about the ring 36. The ring 36 is in the form of a sleeve 38 having two opposite ends 40, 42 and inner and outer walls 44 and 46, respectively, As best seen in FIG. 1, the sleeve 38 is relatively short in length as measured between its ends 40, 42 in comparison to the diameter of the sleeve 38. The ring 36 is formed in a circular condition as best seen in solid lines in FIG. 3 and is constructed of a plastic material possessing a degree of flexibility and resiliency so that the outer walls 46 of the ring 36 can be deformed from the FIG. 3 solid-line (i.e., circular) condition to the condition illustrated in phantom lines (i.e., oval) in FIG. 3. When forces exerted upon the ring 36 for maintaining the ring 36 in its FIG. 3 phantom-line condition are relieved from the ring 36, the memory of the ring 36 returns the ring to the FIG. 3 solid-line condition.

In accordance with the present invention and with reference again to FIG. 1, the ring 36 is adapted to be snugly received by the opening 30 of the plastic bag 24. To this end, the size of the ring 36 as measured across the opening of the ring 36 is slightly less than the size of the bag opening 30. It follows that when the ring 36 is operatively received by the bag opening 30, the ring 36 provides a liner which effectively maintains the bag opening 30 in an opened condition.

With reference still to FIGS. 1–3, the securing means 37 of the adapter 22 includes a plurality of spike-like formations 48 joined to the ring 36 so as to project generally radially outwardly of the ring 36. In the depicted adapter 22, there are two formations 48 attached to the outer wall 46 of the ring 36 and situated at locations thereabout which are substantially diametrically across the ring 36 from one another. Each formation 48 defines a tip 50 which is canted generally upwardly, as viewed in FIG. 1, and which is adapted to puncture the walls of the plastic bag 24 when the bag 24 is pressed against the tip 50.

In further accordance with the present invention, the adapter 22 includes means, generally indicated 52, for supporting the ring 36 from a support structure, such as a trash can 45 (FIG. 4), so that the opening 30 of the plastic bag 24 is maintained in an open-end-up condition for accepting trash placed therein. The trash can 45 of FIG. 4 includes means 55 defining a cylindrically-walled receptacle and a mouth 57 providing ingress into and egress from the receptacle. The receptacle-defining means 55 further includes a border section 59 encircling so as to border the mouth 57.

Figure 4:
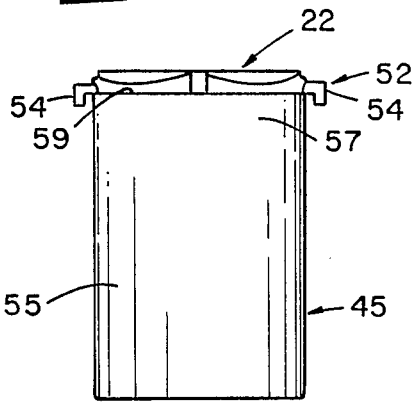
FIG. 4 is a side elevation view of the assembled adapter and bag of FIG. 1 shown operatively positioned within a trash can.

In the depicted adapter 22, the support means 52 includes a pair of radially outwardly-directed projections 54 positioned on diametrically opposite locations across the ring 36 for projecting through the handle-providing apertures 34 defined in the bag 24 and supporting the ring 36 and bag 24 across the top of the trash can 54. As best shown in FIGS. 1 and 4, each projecting portion 54 is somewhat L-shaped in cross section having a first leg which is integrally joined to the outer wall 46 of the ring 36 so as to project generally perpendicular therefrom and a second leg which is joined to so as to project generally downwardly from the first leg. When the leg 38 is operatively positioned across the trash can mouth 57 and with reference to FIG. 4, the projecting portions 54 overlie the top edge of the trash can 54 and the downwardly-depending legs of the projecting portions 54 are hooked about the border section 59 of the trash can 45.

In accordance with the present invention and when the bag 24 is operatively positioned about the ring 36, the ring 36 is sized to be closely received by the mouth 57 of the trash can 45. Accordingly, the size of the ring 36, when measured across its opening, is slightly less than that of the mouth 57 of the trash can 45 when the mouth 57 is measured thereacross.

In order to position the adapter 22 within the bag 24, the ring 36 is positioned within the mouth 30 of the bag 24 so that the ring 36 is snugly encircled by the bag edge portion 32. The walls of the bag 24 are then pressed against the tip 50 of each spike-like formation 48 so that the bag wall is punctured by the tip 50 and so that the bag edge portion 32 is thereby hooked about the formations 48. The bag edge portion 32 is thereby secured to the adapter 22, and the bag opening 30 is maintained by the ring 36 in an opened condition. The bag 24 can thereafter be placed bottom-and-first within the receptacle 55 of the trash can 45 so that the projections 54 of the adapter 22 rest across the top edges of the trash can 45 and so that the bag walls 26 effectively line the inside of the trash can receptacle 55. When the bag 24 becomes full of trash, the bag 24 can be lifted from the trash can 45 with the adapter 22. The filled bag 24 is thereafter removed from the adapter 22 for reuse of the adapter 22.

An advantage provided by the adapter 22 relates to the capacity of the ring 36 to flex and thereby conform to the mouths of trash cans having different shapes. For example and as mentioned above, the ring 36 can be flexed between the FIG. 2 circular (i.e., solid-line) condition to the FIG. 2 oval (i.e., phantom-line) condition so that the ring 36 can be conformed to the shape of trash can mouths having either a circular shape or an oval shape. It would also be understood that once positioned within the mouth of a trash can having a non-circular mouth, the memory of the ring 36 biases the ring 36 toward its unflexed, or circular, condition so that parts of the outer walls 46 of the ring 36 are biased against the inside wall of the trash can border section. Such biasing is believed to contribute to the maintenance of the ring 36 in a stationary condition with respect to the trash can mouth, and the adapter 22 is believed to be further advantageous in this respect.

Figure 5:
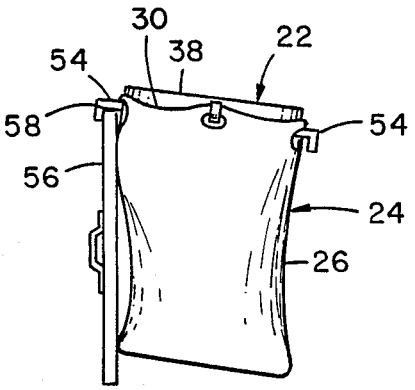
FIG. 5 is a side elevation view of the assembled adapter and bag of FIG. 1 shown operatively suspended from the door of a kitchen cabinet.

As described above, the projecting portions 54 of the adapter 22 provide means by which the ring 36 can be supported across the mouth of a trash can 45. It will be understood, however, that either of the projecting portions 54 can be used to suspend the plastic bag 24 from the top edge of a cabinet door. For example, there is illustrated in FIG. 5, a door 56 of a kitchen cabinet, which door defines a horizontally-extending upper edge 58 from which the bag 24 can be supported by means of the adapter 22. More specifically, one of the projecting portions 54 of the adapter 22 is hooked across the door upper edge 58 so that the door 56 is thereby positioned between the downwardly-depending leg of the portion 54 and of the outer wall 46 of the ring 38 and so that the ring 38 is supported in a cantilever fashion from the door 56. It follows that when the adapter 22 is operatively utilized to suspend the plastic bag 24 from the door edge 56 in the aforedescribed manner, the ring 34 maintains the bag opening 30 in condition for accepting trash placed therein.

For purposes of illustration, the following dimensions are provided for an adapter 22 used to support a plastic grocery bag 24 defining an opening 30 having a diameter of about 10.0 inches within a cylindrically-walled trash can having a mouth diameter of about 10.5 inches. The diameter of the ring 36, when in an unflexed condition, is about 10.25 inches; the distance as measured between the ring ends 40 and 42 is about 3.0 inches; the length of the leg of the projecting portion 54 which is intregally joined to the ring outer surface 46 is about 0.75 inches as measured from the outer wall 46 to the second or downwardly-depending leg of the portion 54; the length of the second leg of the projecting portion 54 as measured from the bottom to the top thereof is about 1.5 inches; the width of each projecting portion 54 is about 2.0 inches; and the length of each spike-like formation 48 is about 1.0 inches.

Figure 6:
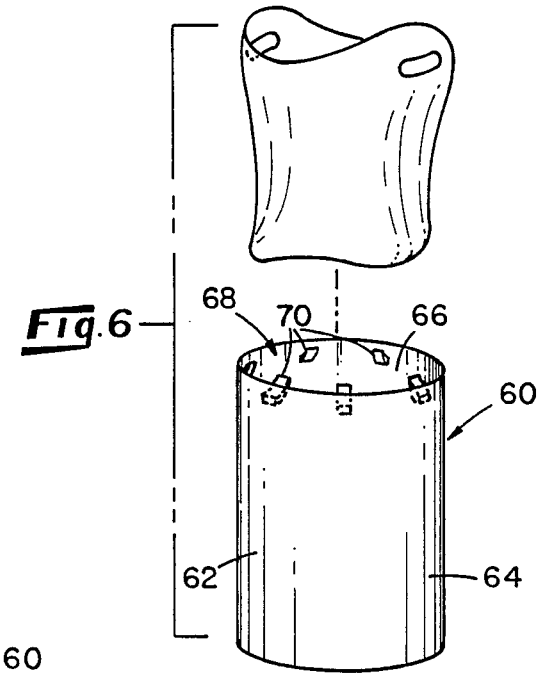
FIG. 6 is a perspective view of a trash can in accordance with another aspect of the present invention and a plastic grocery bag for positioning within the trash can.
Figure 7:
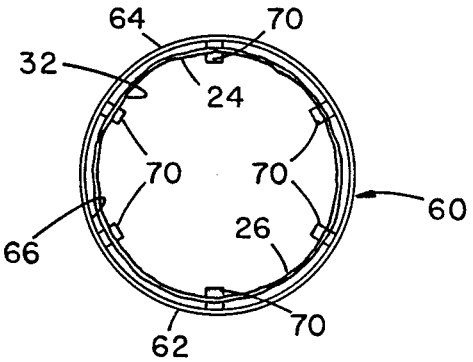
FIG. 7 is a plan view of the FIG. 6 trash can and bag in an assembled condition and as seen generally from above in FIG. 6.

With reference to FIGS. 6 and 7, there is illustrated a trash can, generally indicated 60, in accordance with another aspect of the present invention. The trash can 60 includes a receptacle portion 62 including rigid tubular side walls 64 defining an open mouth 66 and means, generally indicated 68, for supporting the plastic bag 28 within the receptacle portion 62. In the depicted embodiment 60, the support means 68 includes a plurality of radially inwardly-projecting spike-like formations 70 attached to and regularly disposed along the inside wall of the receptacle portion 62. Each formation 70 terminates in a sharpened tip adapted to puncture the walls of the plastic bag 24 when the bag walls are pressed against the tip of the formation 70.

To operatively position a plastic bag 24 within the trash can 60, the bag 24 is positioned bottom-end-first through the mouth 66 of the trash can 60 so that the edge portion 32 of the bag 24 is positioned adjacent the spike-like formations 70. The walls of the bag edge portion 32 are then urged radially outwardly so that the formations 70 puncture the edge portions 32 to thereby hook the edge portion 32 about the formations 70. The bag 24 is thereby suspended within the receptacle portion 62 from the formations 70. Removal of the bag 24 from the trash can 60 is effected by unhooking the bag edge portion 32 from every formation 70 and lifting the bag 24 from the receptacle portion 62.

Figure 9:
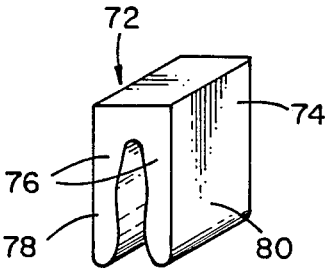
FIG. 9 is a perspective view of one of the clips of FIG. 8.
Figure 8:
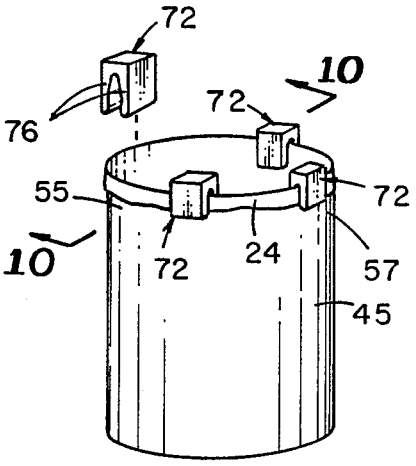
FIG. 8 is a perspective view of a plurality of clips in accordance with a further aspect of the present invention shown operatively utilized for securing a plastic bag within the mouth of a trash can.
Figure 10:
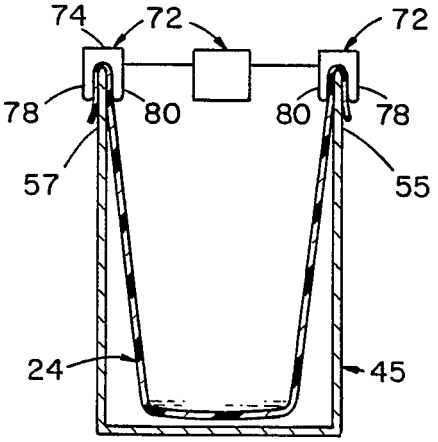
FIG. 10 is a cross-sectional view taken about on lines 10—10 of FIG. 8.

With reference to FIGS. 8–10, there is illustrated a clip, generally indicated 72, in accordance with a further aspect of the present invention for securing a plastic bag 24 within a trash can 45. The trash can 45 of FIGS. 8 and 10 is identical to the trash can 45 of FIGS. 4 and 5 and, accordingly, the components thereof bear the same reference numerals. As best shown in FIG. 9, the clip 72 includes a body 74 having two arms 76 joined together so that two free end portions, indicated 78 and 80, of the arms 76 extend generally away from the region of the body 74 at which the arm 76 are joined. The clip body 74 is constructed of a resiliently flexible material, such as a suitable plastic, which provides the end portion 78 and 80 with a degree of resiliency so that the end portions 78 and 80 flex apart when a separation force is applied thereto and so that the end portions 78 and 80 return to their unflexed condition by the inherent memory of the material out of which the body 74 is constructed once the separation force is relieved.

To secure a plastic bag 24 within the trash can 45 and with reference to FIG. 10, the bag 24 is positioned bottom-end-first through the mouth 55 of the trash can 45 and the edge portion 32 of the bag 24 bordering the bag opening 30 is draped across the upper edges of the can 45 in the manner shown in FIG. 10. At that point, the clip 72 is positioned about the draped bag edge portion 32 so that the bag edge portion 32 and border section 59 of the trash can 45 are tightly held between the free end portions 78 and 80 of the clip arms 76. Accordingly, the distance as measured between the free end portions 78 and 80 is slightly smaller than the thickness of the trash can border section 59 so that the insertion of the clip 72 about the bag edge portion 32 and can border section effects a spreading apart of the free end portions 78 and 80. To remove the bag 24 from the trash can 45, each clip 72 is removed from the border section 59 and the bag 24 is lifted from the trash can 45.

Figure 11:
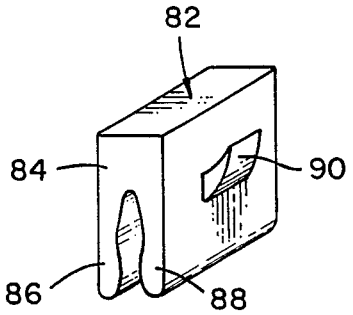
FIG. 11 is a perspective view of another embodiment in accordance with a further aspect of the present invention.

It will be understood that numerous modifications and substitutions can be made to the aforedescribed embodiments without departing from the spirit of the invention. For example, although the clip 72 of FIGS. 8–10 has been shown and described above for positioning about the border section of the can 45 and the edge portion 32 of the bag 24 draped thereacross, a clip in accordance with the border aspects of the present invention may be constructed in a manner permitting the bag 24 to be suspended directly from the clip. For example, there is shown in FIG. 11 a clip 82 in accordance with a still further aspect of the present invention having a body 84 including two arms 86 and 88 joined together so that the free end portions thereof extend generally alongside one another and a spike-like formation 90 fixedly secured to one side of the clip body 84.

When utilized for securing a plastic grocery bag 24 within a trash can, the clip 82 is positioned about the edge of the trash can mouth so that the arms 86 and 88 thereof are positioned on opposite sides of the top edge of the trash can and so that the spike-like formation 90 is directed generally inwardly of the trash can. The spike-like formation 90 is adapted to puncture the wall of the plastic bag 24 when the bag wall is pressed thereagainst so that the bag 24 can be suspended within the trash can in the manner in which a plastic bag 24 is suspended within the trash can 60 of FIGS. 6 and 7.

Figure 12:
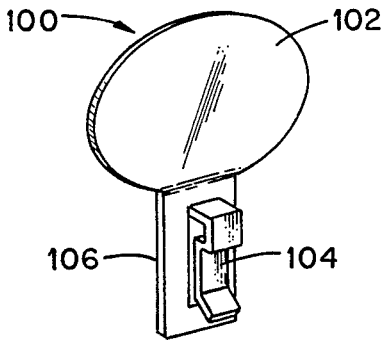
FIG. 12 is a perspective view of still another embodiment in accordance with a further aspect of the present invention.
Figure 13:
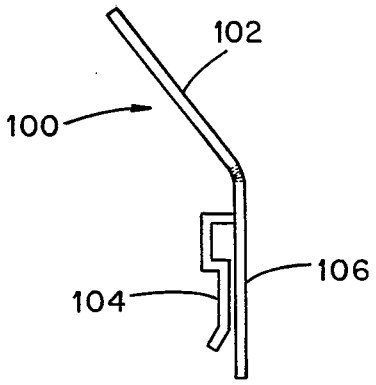
FIG. 13 is a side elevation view of the FIG. 12 embodiment as seen generally from the right in FIG. 12.

Furthermore, there is illustrated in FIGS. 12 and 13 a clip 100 having a circular tab portion 102 and arms 104, 106 depending from the tab portion 102. The clip 100 is constructed of a resilient plastic material and its arms 104, 106 are adapted to pressingly engage the inside and outside surfaces of a trash can when the arms 104, 106 are operatively directed over the edge of a trash can. The tab portion 102 is disposed at an angle with respect to the arms 104, 106, and a plastic garbage bag operatively positioned about the clip 100 is arranged so that one of its handle openings is positioned about the tab portion 102. Accordingly, the aforedescribed embodiments are intended for the purpose of illustration and not as limitation.

What is claimed is:

1. A clip for securing a plastic bag within a trash container wherein the plastic bag includes walls defining an opening providing ingress into and egress from the interior of the bag and an edge portion bordering so as to encircle the bag opening, which edge portion may define a pair of apertures located on diametrically-opposed sides of the bag for providing handles with which the bag can be carried, and wherein the trash container includes a receptacle defining an upwardly-directed mouth and a border section bordering the mouth, said clip comprising:

a body providing two joined arms adapted to be snugly secured about the border section of the trash container receptacle for attaching the bag edge portion to the mouth of the trash container receptacle as the bag edge portion is positioned between the arms of the clip and the receptacle border section and a tab portion about which a handle-providing aperture of a bag can be hooked for suspension of the bag from the mouth of the trash container so that the clip can be used to secure a plastic bag within a trash container receptacle whether or not the bag includes a handle-providing aperture;

each arm having two opposite ends and said arms being joined so that an end of one arm is attached to an end of the other arm and so that the two arms extend generally alongside one another for positioning on opposite sides of the border section of the trash container receptacle;

one arm being generally planar and straight as a path is traced from the joined end of said one arm to the opposite end thereof and the other arm having in sequence a U-shaped section, a planar intermediate section and a flared end section as a path is traced from the joined end of said other arm to the opposite end thereof, each of the U-shaped section, intermediate section and said flared end section being positioned adjacent corresponding sections of said one arm;

said flared section of said other arm cooperating with a corresponding section to said straight arm so as to provide an entrance between the arms which is substantially V-shaped in cross section and arranged so that its V opens downwardly to facilitate manipulation of the clip onto the border section of the trash container receptacle as the V-shaped entrance is positioned upon the receptacle border section and subsequently urged downwardly thereon;

the intermediate section being spaced from the plane of a corresponding section of the straight arm by a distance which is slightly smaller than the thickness of the container border section with which the clip is used so that when an edge portion of a plastic bag is draped across the border section of the trash container receptacle and the clip is operatively urged downwardly about the border section with the bag edge portion draped thereacross so that the arms of the clip are positioned on opposite sides of the border section, the bag edge portion and border section are tightly secured between the arms of the clip;

said clip being constructed of a resiliently flexible material so that the arms are adapted to flex apart as the clip is forced downwardly onto the border section of the trash container receptacle and so that the memory of the arms bias the arms toward their unflexed condition, said U-shaped section being arranged so as to open generally toward the plane of said straight arm for accommodating a relatively large amount of flexing per unit length of said other arm so that said clip can be secured about the border section of a trash container receptacle having a thickness within a broad range of thicknesses;

said tab portion being generally planar in shape and joined to said straight arm adjacent the joined end thereof so as to be arranged in an angular orientation with respect to the plane of said straight arm so that when the clip is operatively positioned upon the border section of a trash container receptacle and the straight arm is oriented substantially vertically, the tab portion is oriented at an angle with respect to the receptacle border section.

* * * * *